US005220894A

United States Patent [19]

Straubel

[11] Patent Number: 5,220,894

[45] Date of Patent: Jun. 22, 1993

[54] FUEL INJECTION PUMP FOR INTERNAL COMBUSTION ENGINES

[75] Inventor: Max Straubel, Stuttgart, Fed. Rep. of Germany

[73] Assignee: Robert Bosch GmbH, Stuttgart, Fed. Rep. of Germany

[21] Appl. No.: 700,125

[22] PCT Filed: Oct. 24, 1990

[86] PCT No.: PCT/DE90/00801

§ 371 Date: May 28, 1991

§ 102(e) Date: May 28, 1991

[87] PCT Pub. No.: WO91/07585

PCT Pub. Date: May 30, 1991

[30] Foreign Application Priority Data

Nov. 13, 1989 [DE] Fed. Rep. of Germany ..... 3937709

[51] Int. Cl.[5] ..... F02M 41/00

[52] U.S. Cl. ..... 123/449; 123/496

[58] Field of Search ..... 123/449, 503, 496, 450

[56] References Cited

U.S. PATENT DOCUMENTS

| | | | |
|---|---|---|---|
| 2,937,637 | 5/1960 | Heiser | 123/449 |
| 3,405,700 | 10/1968 | Hoefer | 123/449 |
| 4,407,249 | 10/1983 | Eheim | 123/449 |
| 4,409,939 | 10/1983 | Eheim | 123/449 |
| 4,449,504 | 5/1984 | Furuhashi | 123/449 |
| 4,463,726 | 8/1984 | Roca-Nierga | 123/449 |
| 4,604,979 | 8/1986 | Kobayashi | 123/449 |
| 4,974,564 | 12/1990 | Laufer | 123/449 |

*Primary Examiner*—Carl S. Miller

*Attorney, Agent, or Firm*—Edwin E. Greigg; Ronald E. Greigg

[57] ABSTRACT

A fuel injection pump for internal combustion engines for controlling the fuel quantity with an electric closed-loop control device, which controls an electric positioner, which in turn actuates an element that determines the fuel injection quantity per pump piston supply stroke. The supply of fuel to the pump work chamber is effected via a fuel supply line, in which an adjustable throttle is disposed. The throttle is actuated in accordance with the position of a gas pedal, but it controls an increasingly larger through cross section of the fuel supply line than would correspond to the fuel metering by the closed-loop control device. A minimum through cross section is defined by a fixed throttle. With this apparatus, emergency operation if the electric control system for the fuel injection quantity fails can be attained, without the apparatus for emergency operation interfering with fuel metering by the closed-loop control device. In particular, the fixed throttle prevents racing of the engine counter to the intentions of the driver in the event that the closed-loop control system fails.

30 Claims, 3 Drawing Sheets

FUEL INJECTION PUMP FOR INTERNAL COMBUSTION ENGINES

BACKGROUND OF THE INVENTION

The invention is based on a fuel injection pump for internal combustion engines as generically defined hereinafter. In such a fuel injection pump, known from German Patent 30 13 368, an in-line injection pump is provided with an electronic governor to which the intended load is input via a gas pedal. At each cylinder of the injection pump, a throttle controlling the intake bore to this cylinder is adjusted by this gas pedal. This throttle is intended to assure maintenance of engine operation if the governor fails and to reliably avoid exceeding a maximum rpm. This apparatus has the disadvantage that the throttle on the input side causes a filling loss of the pump work chambers, which for normal operation must be compensated for again by the governor. This necessitates greater expense in terms of construction, because the fuel injection pump must be designed for an intrinsically higher capacity than what it actually puts out.

ADVANTAGES OF THE INVENTION

The fuel injection pump according to the invention has the advantage over the prior art that the function of fuel injection quantity governing, when the governor is intact, is in no way interfered with, yet on the other hand if the governor has failed, the adjustable throttle, with the minimum constant flow cross section that continues to be provided, enables idling and operation under load for emergency operation. Advantageous further features of the provisions disclosed herein are recited in the dependent claims. Particularly advantageously, control of the throttle device of the throttle is achieved so that an rpm-dependent and load-dependent mechanical control of the fuel injection pump can be performed if the governor has failed.

DRAWINGS

Four exemplary embodiments, with three variants of one exemplary embodiment, are shown in the drawings and described in further detail in the ensuing description. Shown are in FIG. 1 illustrate a first exemplary embodiment of a fixed throttle located in a bypass around a throttle in the fuel supply line; FIG. 2 illustrate a variant of the exemplary embodiment of FIG. 1 having a seat valve as the throttle; FIG. 3 illustrate a second variant of the exemplary embodiment of FIG. 1, in a further development of FIG. 2, having a flow cross section forming the fixed throttle, in the valve closing element of the feed valve; FIGS. 4*a* and 4*b* illustrate a third variant of the exemplary embodiment of FIG. 1, with a fixed throttle integrated with a rotary slide, seen in three functional positions; FIG. 5 illustrate the second exemplary embodiment of the invention, having a throttle adjustable as a function of rpm; FIG. 6 illustrate a third exemplary embodiment, having a throttle body provided with an oblique control edge; and FIG. 7 illustrate a fourth exemplary embodiment as a modification of that shown in FIG. 6, having a pressure-equalizing annular groove.

DESCRIPTION OF THE EXEMPLARY EMBODIMENTS

Figure 1:
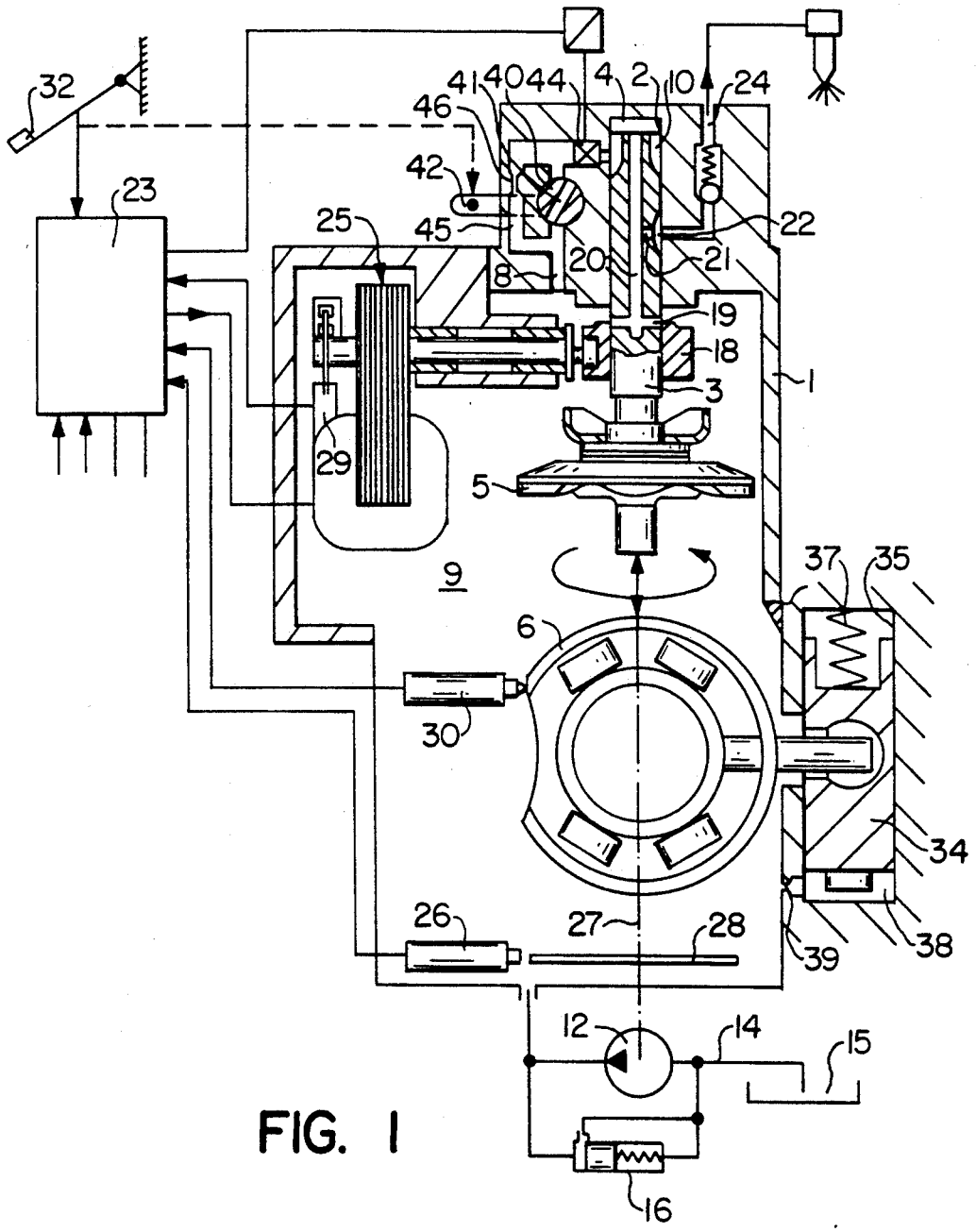

In the exemplary embodiment shown in FIG. 1, a cylinder bore 2, in which a pump piston 3 encloses a pump work chamber 4, is provided in a pump housing 1 of a fuel injection pump. The pump piston is rotatingly driven by means not further shown, via a cam disk 5 that runs on a roller race 6 (shown folded over by 90 into the plane of the drawing), and in its rotational motion executes a reciprocating pump motion with an intake stroke and a supply stroke. The supply of fuel to the pump work chamber is effected via a fuel supply line 8, which leads from a fuel supply chamber 9 serving as a fuel supply source to the cylinder 2; the fuel entry into the cylinder is controlled via longitudinal grooves 10 beginning at the end face of the pump piston. The fuel supply chamber is located inside the pump housing and is supplied with fuel by means of a fuel feed pump 12, which typically is driven synchronuously with the pump piston. To this end, the fuel feed pump communicates with a fuel supply tank 15 via an intake line 14. Connected parallel to the fuel feed pump is a pressure control valve 16 by means of which, beyond the rpm-dependent pumping of the fuel feed pump, the pressure in the fuel supply chamber 9 is controlled. To perform a control of injection time, the pressure is preferably dependent on the rpm at which the fuel injection pump is driven.

On the side toward the cam disk, the pump piston protrudes into the fuel supply chamber, and on this portion of the pump piston it has an annular slide 18, with the upper edge of which the outlet, for example, of a transverse bore 19 of the pump piston into the fuel supply chamber 9 is controllable. In the pump piston, a longitudinal bore 20 begins at the transverse bore 19 and communicates continuously, as a relief conduit, with the pump work chamber 4. A radial bore 21 branches off from the relief conduit and discharges into a distributor groove 22. The distributor groove is made to communicate with one fuel injection line 24 at a time in succession, upon rotation of the pump piston during its supply stroke. The fuel injection lines are disposed on the circumference of the cylinder bore 2 in the working range of the distributor groove 22 and correspond in number to the number of engine cylinders to be supplied.

The annular slide 18 serves to control the fuel injection quantity and is axially displaced on the pump piston by an electromagnetic positioner 25, and the quantity of fuel pumped per pumping stroke of the pump piston into one of the injection lines is greater, the more the annular slide 18 has been displaced toward top dead center of the piston. The electromagnetic positioner, as a control device for controlling the fuel injection quantity, is controlled by an electric closed-loop control device 23, which furnishes a control signal to the positioner 25 in accordance with operating parameters. As one of the operating parameters, the engine rpm is detected via an rpm transducer 26, which cooperates with a toothed disk 28 coupled to the drive shaft 27 of the fuel injection pump. This drive shaft also drives the cam disk 6. The established position of the electromagnetic positioner 25 is also detected by a feed back transducer 29, and the location of the injection time is detected for the control system with an injection timing transducer 30. In the embodiment described, this may be a transducer that detects the position of the roller race 6, or other injection timing transducers such as needle stroke transducers or the like, may be provided. Via a gas pedal 32, a signal corresponding to the desired torque to be output by the engine is fed to the closed-loop control device. Still other parameters, such as the temperature or density of the air delivered to the engine combustion chambers, can be taken into account in forming the fuel quantity signal for triggering the positioner. Such control systems are well known and need not be described in further detail here.

For adjusting the instant of injection, an injection adjuster piston 34 is also shown, which is displaceable in a work cylinder 35 and is coupled to the roller race 6; on one side, it is loaded with a restoring spring 37, and on the other side it encloses a work chamber 38 in the work cylinder, and this chamber communicates with the fuel supply chamber 9, via a decoupling throttle 39. With the pressure in the fuel supply chamber, which increases with the rpm, the injection adjusting piston is displaced counter to the force of the spring 37, and in so doing rotates the roller race 6 such that the piston stroke motion takes place at an earlier rotary angle of the injection pump drive shaft 27.

To this point, the described pump is a known fuel injection pump of the distributor pump type, with electrical control. Such electrical control systems may fail for various reasons, or may malfunction, so it is advantageous to provide additional provisions to assure that a maximum rpm of the engine supplied by the fuel injection pump cannot be exceeded, so that if the electrical control system fails, emergency operation of the engine can be maintained. This emergency operation is intended to assure that the engine can be operated, at least at low load, until such time as the vehicle can leave a dangerous situation or reach a repair facility on its own power. To this end, a throttle 40, in the form of a rotary slide with a through bore 41, is disposed in the fuel supply line 8. This throttle is actuatable simultaneously with the gas pedal 32 by means of an external lever 42 and controls the cross section of the fuel supply line. Downstream of this throttle, an electromagnetically actuatable shutoff valve 44 can be provided in the fuel supply line 8, directly before it discharges into the cylinder 2; to shut off the engine, the shutoff valve can completely interrupt the supply of fuel to the pump work chamber 4. This valve is likewise controlled by the closed-loop control device 23, if the supply of current to the closed-loop control device is interrupted by means of an ignition switch, for instance.

A fixed throttle 46, which determines the minimum through cross section from the fuel supply chamber 9 to the cylinder bore 2 or pump work chamber 4, is disposed parallel to the adjustable throttle 41 in a bypass line 45. Instead of the adjustable throttle embodied as a rotary slide, a correspondingly actuatable seat valve 140 may also be provided, with a fixed throttle 46 also located parallel to it, as in FIG. 2, or a seat valve 240 may be provided as in FIG. 3, in which case the fixed throttle is embodied as a bore 48 through the closing element 49 of the seat valve 240.

Figure 2:
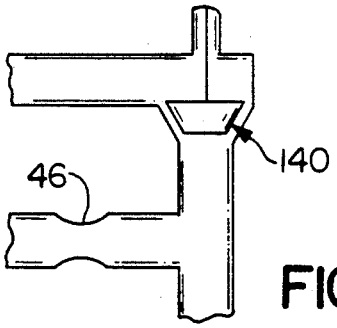
Figure 3:
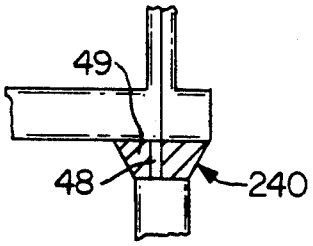
Figure 4:
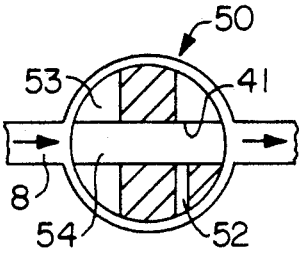
Figure 4A:
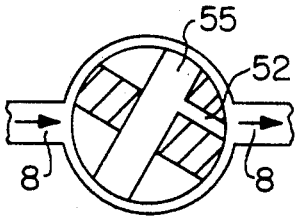
Figure 4B:
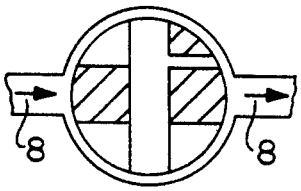

The adjustable throttle is embodied in such a way and triggered by the gas pedal in such a way that even at the slightest motions of the gas pedal, the through cross section of the fuel supply line 8 can be opened very quickly, so that the electric closed-loop control device is not impaired in its capacity to function, and the fuel injection quantity is controlled by the annular slide 18, without being influenced by the adjustable throttle. This can be performed particularly effectively, above all, if a cone seat valve 140 or 240 as in the embodiments of FIGS. 2 and 3 is used. If the electric closed-loop control device or the positioner should fail, the adjustable throttle takes on the control of the fuel injection quantity, in the manner of a closed-loop intake throttle control. To this end, the adjustable throttle is now likewise adjusted as a function of the gas pedal 32 and it varies the inflow cross section to the pump work chamber. The fixed throttle 46 determines the minimum inflow cross section, which at a minimum must be large enough that the entire idling load increase and the delivery of fuel for starting of the engine are assured. With increasing rpm, the flow, with respect to the individual pumping stroke of the pump piston, drops in a ratio of 1/n. Because the friction of the engine increases with the rpm, a balance is established at medium rpm between the power brought to bear in accordance with the fuel quantity delivered and the resistances. Even if the positioner 25 were sent to full fuel injection quantity, racing of the engine can be prevented, in that the driver lets up on the gas pedal 32 to affect the power, the through bore 41 of the adjustable throttle 4 is closed, and the inflow of fuel to the pump work chamber is determined by the fixed throttle. The above-given equilibrium ratio is established, which may correspond to an idling rpm or an average low rpm. The fixed throttle may also be disposed in a rotary slide 50, as shown in three positions in FIG. 4. In that case the rotary slide represents the adjustable throttle, which is equivalent to the adjustable throttle 40 of FIG. 1, and has a through bore 41. Branching off from that bore is a transverse conduit 52 embodied as a throttle bore. On the inlet side, the through bore 1 has a cross-sectional enlargement 53, such that the inlet 54, in one rotary position of the rotary slide, still communicates with the fuel supply line 8 on the inlet side, in that the outlet 55 of the through bore 41 is closed, while the transverse conduit 52 communicates with the fuel supply line 8 extending onward. In this second position of FIG. 4, the fixed throttle, in the form of the transverse conduit 52, is accordingly in line with the through bore 55. Finally, upon further rotation of the rotary slide 50, the fuel supply line 8 can be closed completely. Thus the engine, or its supply by the fuel injection pump, can be stopped completely via the rotary slide 50, even if the electromagnetically actuatable shutoff valve 44 is not operative.

Figure 5:
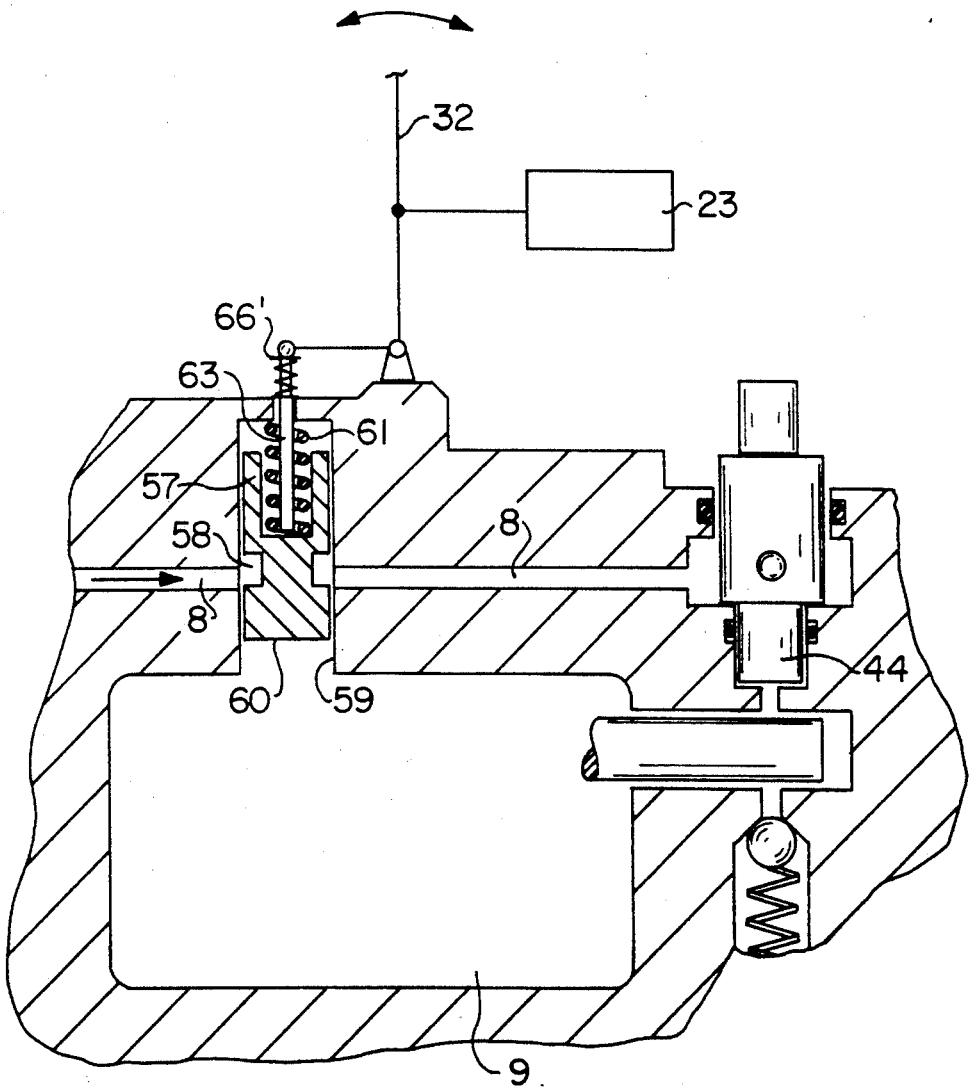

If the characteristic curve of the simple throttle bore of the fixed throttle 46 does not provide breakaway control steeply enough for the fuel injection quantity if the electric control system fails, or in other words if it establishes an excessively high full-load rpm, then instead of a simple throttle valve, a device as shown in FIG. 5 can be used. In FIG. 5, instead of the rotary slide 50, a longitudinal slide 57 is provided as the throttle body of the throttle; it has an annular groove 58 on its circumference and is tightly displaceable in a blind bore 59 that is open toward the fuel supply chamber. The face end 60 of the longitudinal slide 57 is thus acted upon by the rpm-dependent pressure in the fuel supply chamber and can be displaced counter to a restoring spring 61 that engages its other face end. This displacement travel is limited by an adjustable stop 63, which in turn is actuated from the gas pedal 32 in accordance with the triggering of the rotary slide 40 of FIG. 1. Upon adjustment in the direction of increased load, the longitudinal slide 57 is displaced counter to the pressure in the fuel supply chamber, and the annular groove 58 increasingly comes to overlap the fuel supply line 8, which is preferably supplied with fuel from a constant pressure source. A variable cross section can thus be controlled mechanically, and if the stop 63 is adjusted in the direction of the least load, a control of quantity can be attained via the equilibrium between the restoring spring 61 and the force acting upon the longitudinal slide on the side toward the fuel supply chamber. The restoring spring 61 can in this case take on the function of an idling spring, which controls the flow cross section in the fuel supply line 8 at the annular groove 58. Otherwise, the fuel injection pump has the same structure as that of the exemplary embodiment of FIG. 1. In principle, by means of an additional stop, a remaining flow cross section at the annular slide 58 can also be established, and by manual actuation, an opportunity can be created for closing the flow cross section of the fuel supply line 8 completely.

As a safety provision against an overly high rpm if the fuel control system fails, a spring clamp 66' can be inserted in series in the travel transmission between the gas pedal 32 and the adjustable stop; at excess rpm and hence with a sharply increasing pressure in the fuel supply chamber 9, this spring clamp is compressed, enabling closure of the fuel supply line and breakaway control of the fuel injection quantity.

Figure 6:
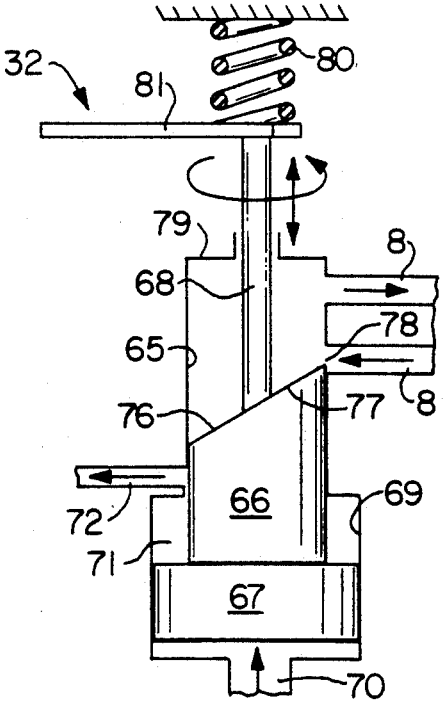

FIG. 6 shows a modified version of the exemplary embodiment of FIG. 5. Here, a cylindrical throttle body 66 that is tightly displaceable in a guide cylinder 65 is provided; on one end, it is changes into a piston 67 of larger diameter, and on the other end it changes into a piston 68 of smaller diameter. The piston having the larger diameter slides tightly in a cylinder 69, which adjoins the guide cylinder 65 and opposite it communicates via an inlet opening 70 with the control pressure source, that is, the fuel supply chamber 9, which is under rpm-dependent pressure. The chamber 71 enclosed in the cylinder 69 on the end of the piston 67 opposite the inlet opening 70 is pressure-relieved via a relief line 72 or leakage line.

The shoulder 76 embodied at the transition between the cylindrical throttle body 66 and the piston 68 having the smaller diameter, extends obliquely, forming an oblique control edge 77, by means of which an inflow opening 78 of the fuel supply line 8 that discharges into the guide cylinder 65 can be controlled. The guide cylinder 65 is closed on the face end, and from the part of the guide cylinder enclosed by the shoulder 76, the fuel supply line 8 leads onward unclosably to the pump work chamber of the fuel injection pump. The piston 68 having the smaller diameter is passed tightly through the face end 79 of the guide cylinder 65 and is loaded there on the face end by a restoring spring 80 corresponding to the restoring spring 61, in such a manner that the throttle body 66, by means of the piston 67, is displaceable by the rpm-dependent pressure of the suction chamber 9 counter to the force of the restoring spring 80 and thus, with its oblique control edge 77, controls the inlet cross section of the inflow opening 78. To vary the rotational position of the throttle body 66, this body is guided variably in its rotational position via a lever 81; the lever 81 is variable in its rotational direction in accordance with the position of the gas pedal. Depending on the rotational position of the throttle body, the inflow opening 78 is accordingly opened or closed completely, in accordance with an earlier or later travel. Thus the rpm at which the fuel supply undergoes breakaway control or is variable, which is expressed in the rpm-dependent pressure of the fuel supply chamber, or in other words the throttle that throttles the cross section of the fuel supply line 8 via the oblique control edge, is also adjustable as a function of load.

Figure 7:
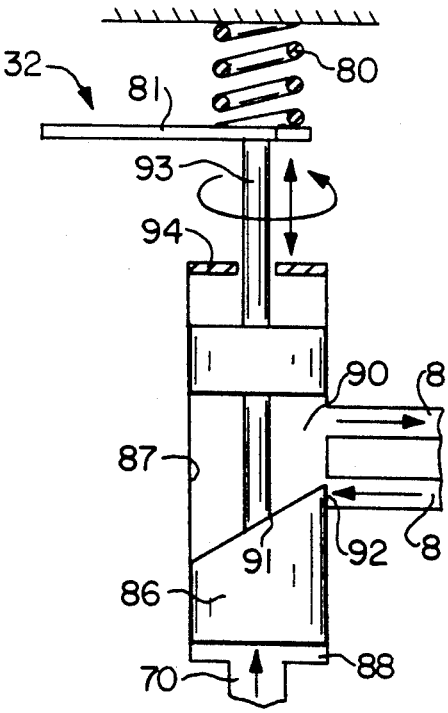

A variant version of the exemplary embodiment of FIG. 6 is shown in FIG. 7. It differs from FIG. 6 in that the piston 67 of larger diameter adjoining the cylindrical throttle body 66 is dispensed with, so that in this case the cylindrical throttle body 86, by one face end, defines a pressure chamber 88 in the guide cylinder 87 that communicates with the fuel supply chamber 9 via the inlet opening 70. The cylindrical throttle body 86 also has an annular groove 90, one defining wall of which, toward the inlet opening 70, extends obliquely to the longitudinal axis of the throttle body, forming an oblique control edge 91. The fuel supply line 8 leads unclosably away from the annular groove 90 to the pump work chamber, and via an inlet opening 92, controlled by the oblique control edge 91, the fuel supply line 8 discharges into the annular groove 90. The cylindrical throttle body is guided, in a manner similar to the exemplary embodiment of FIG. 6, via a piston 93 of lesser diameter; the piston 93 extends to the outside through the end wall 94 of the guide cylinder 87, and there it has the lever 81 for rotating the throttle body 86 and is acted upon by the restoring spring 80 counter to the fuel pressure in the pressure chamber 88. This embodiment has the advantage over the previous one that the throttle body 86 is in force equilibrium with respect to the force acting upon the annular groove 90, or the force acting upon it toward the control edge. Toward the face end 94, the guide cylinder 87 is pressure-relieved, via a leakage line, not shown in detail here.

The apparatus described makes it possible to keep the safety provisions in the control unit at a low level, while achieving increased safety against engine racing. Particularly, the fuel metering is not longer dependent soley on the function or the closed-loop control device and of the positioner. The embodiment according to the invention can also be used if there is some different type of electric closed- or open-loop control of the fuel injection quantity, for instance in fuel injection pumps the pump work chamber of which is opened or closed during the pump piston supply stroke via an electrically controlled valve, and in which the duration and instant of high-pressure fuel production by the pump piston, and thus the injection, are defined upon the closure.

I claim:

1. A fuel injection pump for internal combustion engines, having a housing, a cylinder (2) in said housing, a pump work chamber (4) defined by a pump piston (3) driven to reciprocate in said cylinder, a fuel supply line (8) that is made to communicate with the pump work chamber (4), a throttle (40, 140, 240, 50, 57) disposed in said supply line (8) that is arbitrarily adjustable in accordance with an intended torque output by the engine, via which throttle the pump work chamber is made to communicate with a fuel source (9) at low pressure, upon an intake stroke of the pump piston, a relief conduit (20) leading away from the pump work chamber (4), by which the fuel injection quantity communicates with a low pressure fuel source (9), by means of a control device (25, 18) controllable by an electric closed-loop control device (23) as a function of operating parameters, wherein at least a position of a gas pedal (32) is detected by the electric closed-loop control device (23) for controlling the fuel injection quantity, the adjustable throttle (40-, 140, 240, 50, 57) is movable into a position in which a minimum, constant flow cross section between the fuel source (9) and the pump work chamber (4) is maintained, and in other positions, a larger cross section of the fuel supply line (8) is always opened more than would be necessary to carry the fuel injection quantity, controlled by the electric closed-loop control device, into the pump work chamber (4) in the intake stroke of the pump piston.

2. A fuel injection pump as defined by claim 1, in which the minimum flow cross section is defined by means of a fixed throttle (46, 48) in a bypass around the adjustable throttle.

3. A fuel injection pump as defined by claim 2, in which the adjustable throttle is embodied as a seal valve (140, 240).

4. A fuel injection pump as defined by claim 3, in which the fixed throttle is embodied as a through bore (48) extending through the seat valve closing member (49) of the seat valve (240).

5. A fuel injection pump as defined by claim 1, in which the minimum flow cross section is embodied as a transverse conduit (52), branching off from a through bore (41), in a rotary slide (50), which up to a first rotary position serves as a variable throttle, and in the first rotary position the transverse conduit is in line with the through bore (41) in the fuel supply line (8), and in another rotary position the communication between the adjoining parts of the fuel supply line (8) is interrupted by the rotary slide (50).

6. A fuel injection pump as defined by claim 1, in which the throttle device (57) of the throttle is acted upon counter to the force of a spring (61) by a pressure of the pressure source (9) controlled as a function of rpm, and the travel of the adjustment of the throttle counter to the force of the spring is variable as a function of load, such that an increasingly large opening of the throttle connection in the fuel supply line (8) is established upon gas pedal adjustments in the direction of greater load and/or decreasing rpm.

7. A fuel injection pump as defined by claim 2, in which the throttle device (57) of the throttle is acted upon counter to the force of a spring (61) by a pressure of the pressure source (9) controlled as a function of rpm, and the travel of the adjustment of the throttle counter to the force of the spring is variable as a function of load, such that an increasingly large opening of the throttle connection in the fuel supply line (8) is established upon gas pedal adjustments in the direction of greater load and/or decreasing rpm.

8. A fuel injection pump as defined by claim 3, in which the throttle device (57) of the throttle is acted upon counter to the force of a spring (61) by a pressure of the pressure source (9) controlled as a function of rpm, and the travel of the adjustment of the throttle counter to the force of the spring is variable as a function of load, such that an increasingly large opening of the throttle connection in the fuel supply line (8) is established upon gas pedal adjustments in the direction of greater load and/or decreasing rpm.

9. A fuel injection pump as defined by claim 4, in which the throttle device (57) of the throttle is acted upon counter to the force of a spring (61) by a pressure of the pressure source (9) controlled as a function of rpm, and the travel of the adjustment of the throttle counter to the force of the spring is variable as a function of load, such that an increasingly large opening of the throttle connection in the fuel supply line (8) is established upon gas pedal adjustments in the direction of greater load and/or decreasing rpm.

10. A fuel injection pump as defined by claim 5, in which the throttle device (57) of the throttle is acted upon counter to the force of a spring (61) by a pressure of the pressure source (9) controlled as a function of rpm, and the travel of the adjustment of the throttle counter to the force of the spring is variable as a function of load, such that an increasingly large opening of the throttle connection in the fuel supply line (8) is established upon gas pedal adjustments in the direction of greater load and/or decreasing rpm.

11. A fuel injection pump as defined by claim 6, in which the adjusting travel of the throttle is variable by means of an adjustable stop (63), against which a throttle body (57), controlling the through cross section of the fuel supply line (8), can be brought into contact counter to the force of the spring (61), so as to reduce the through cross section, wherein the adjustable stop is adjusted in accordance to the position of the gas pedal (32).

12. A fuel injection pump as defined by claim 7, in which the adjusting travel of the throttle is variable by means of an adjustable stop (63), against which a throttle body (57), controlling the through cross section of the fuel supply line (8), can be brought into contact counter to the force of the spring (61), so as to reduce the through cross section, wherein the adjustable stop is adjusted in accordance to the position of the gas pedal (32).

13. A fuel injection pump as defined by claim 8, in which the adjusting travel of the throttle is variable by means of an adjustable stop (63), against which a throttle body (57), controlling the through cross section of the fuel supply line (8), can be brought into contact counter to the force of the spring (61), so as to reduce the through cross section, wherein the adjustable stop is adjusted in accordance to the position of the gas pedal (32).

14. A fuel injection pump as defined by claim 9, in which the adjusting travel of the throttle is variable by means of an adjustable stop (63), against which a throttle body (57), controlling the through cross section of the fuel supply line (8), can be brought into contact counter to the force of the spring (61), so as to reduce the through cross section, wherein the adjustable stop is adjusted in accordance to the position of the gas pedal (32).

15. A fuel injection pump as defined by claim 10, in which the adjusting travel of the throttle is variable by means of an adjustable stop (63), against which a throttle body (57), controlling the through cross section of the fuel supply line (8), can be brought into contact counter to the force of the spring (61), so as to reduce the through cross section, wherein the adjustable stop is adjusted in accordance to the position of the gas pedal (32).

16. A fuel injection pump as defined by claim 6, in which a pre-stressed spring clamp is disposed in line with the adjustable stop.

17. A fuel injection pump as defined by claim 7, in which a pre-stressed spring clamp is disposed in line with the adjustable stop.

18. A fuel injection pump as defined by claim 8, in which a pre-stressed spring clamp is disposed in line with the adjustable stop.

19. A fuel injection pump as defined by claim 18, in which a pre-stressed spring clamp is disposed in line with the adjustable stop.

20. A fuel injection pump as defined by claim 10, in which a pre-stressed spring clamp is disposed in line with the adjustable stop.

21. A fuel injection pump as defined by claim 11, in which a pre-stressed spring clamp is disposed in line with the adjustable stop.

22. A fuel injection pump as defined by claim 12, in which a pre-stressed spring clamp is disposed in line with the adjustable stop.

23. A fuel injection pump as defined by claim 13, in which a pre-stressed spring clamp is disposed in line with the adjustable stop.

24. A fuel injection pump as defined by claim 14, in which a pre-stressed spring clamp is disposed in line with the adjustable stop.

25. A fuel injection pump as defined by claim 15, in which a pre-stressed spring clamp is disposed in line with the adjustable stop.

26. A fuel injection pump as defined by claim 6, in which the throttle has a cylindrical, axially adjustable throttle body (66, 68) guided in a cylinder (65, 87) and acted upon on the face end by pressure controlled as a function of rpm, the throttle body having an oblique control edge controlling the through cross section of the fuel supply line discharging into the cylinder and being rotatable in accordance with the adjustment travel of the gas pedal.

27. A fuel injection pump as defined by claim 7, in which the throttle has a cylindrical, axially adjustable throttle body (66, 68) guided in a cylinder (65, 87) and acted upon on the face end by pressure controlled as a function of rpm, the throttle body having an oblique control edge controlling the through cross section of the fuel supply line discharging into the cylinder and being rotatable in accordance with the adjustment travel of the gas pedal.

28. A fuel injection pump as defined by claim 8, in which the throttle has a cylindrical, axially adjustable throttle body (66, 68) guided in a cylinder (65, 87) and acted upon on the face end by pressure controlled as a function of rpm, the throttle body having an oblique control edge controlling the through cross section of the fuel supply line discharging into the cylinder and being rotatable in accordance with the adjustment travel of the gas pedal.

29. A fuel injection pump as defined by claim 9, in which the throttle has a cylindrical, axially adjustable throttle body (66, 68) guided in a cylinder (65, 87) and acted upon on the face end by pressure controlled as a function of rpm, the throttle body having an oblique control edge controlling the through cross section of the fuel supply line discharging into the cylinder and being rotatable in accordance with the adjustment travel of the gas pedal.

30. A fuel injection pump as defined by claim 10, in which the throttle has a cylindrical, axially adjustable throttle body (66, 68) guided in a cylinder (65, 87) and acted upon on the face end by pressure controlled as a function of rpm, the throttle body having an oblique control edge controlling the through cross section of the fuel supply line discharging into the cylinder and being rotatable in accordance with the adjustment travel of the gas pedal.

* * * * *